US011703304B2

(12) United States Patent
Hannah

(10) Patent No.: US 11,703,304 B2
(45) Date of Patent: Jul. 18, 2023

(54) MODULAR GUN STOCKS

(71) Applicant: Durkin Tactical, LLC, Eudora, KS (US)

(72) Inventor: Gary Hannah, Shawnee, KS (US)

(73) Assignee: Durkin Tactical, LLC, Eudora, KS (US)

( * ) Notice: Subject to any disclaimer, the term of this patent is extended or adjusted under 35 U.S.C. 154(b) by 158 days.

(21) Appl. No.: 17/472,576

(22) Filed: Sep. 10, 2021

(65) Prior Publication Data

US 2023/0077334 A1 Mar. 16, 2023

(51) Int. Cl.
*F41C 23/20* (2006.01)
*F41A 3/84* (2006.01)

(52) U.S. Cl.
CPC ..... *F41C 23/20* (2013.01); *F41A 3/84* (2013.01)

(58) Field of Classification Search
CPC ..... F41C 23/20; F41C 23/08; F41C 23/10; F41C 23/14; F41A 3/84
See application file for complete search history.

(56) References Cited

U.S. PATENT DOCUMENTS 8,186,090 B1 * 5/2012 Chiarolanza ..... F41C 23/04 42/73
D668,311 S * 10/2012 Rogers ..... F41C 23/04 D22/108
8,950,099 B2 * 2/2015 Rogers ..... F41C 23/04 42/71.01
8,984,791 B1 * 3/2015 Leslie ..... F41C 23/04 42/71.01
9,109,855 B1 * 8/2015 Kincel ..... F41C 23/20
D831,149 S * 10/2018 Barfoot ..... D22/108
2001/0052197 A1 * 12/2001 Murello ..... F41C 23/20 42/74
2009/0300963 A1 * 12/2009 Hines ..... F41C 23/22 42/75.03
2010/0242328 A1 * 9/2010 Faifer ..... F41C 23/06 42/1.06
2017/0356718 A1 * 12/2017 Johnson ..... F41C 23/20
2018/0003459 A1 * 1/2018 Miller ..... B21D 22/00
2018/0058806 A1 * 3/2018 Moody ..... F41C 23/14
2018/0347939 A1 * 12/2018 Keller ..... F41C 23/04
2019/0017774 A1 * 1/2019 Vanek ..... F41C 23/04
2019/0041160 A1 * 2/2019 Keller ..... F41C 23/04
2020/0182586 A1 * 6/2020 Zhang ..... F41C 23/20
2020/0240743 A1 * 7/2020 Cahill ..... F41C 23/02
2020/0263954 A1 * 8/2020 Reavis, III ..... F41C 23/20
2021/0018296 A1 * 1/2021 Faifer ..... F41C 23/20

* cited by examiner

*Primary Examiner* — Joshua E Freeman
(74) *Attorney, Agent, or Firm* — Law Office of Julie Scott LLC

(57) ABSTRACT

The invention provides improved modular gun stocks and their methods of manufacture. Advantageously, gun stocks of the invention require fewer parts than conventional gun stocks. The lower stock supports of the improved modular gun stocks can be removed and replaced in multiple ways so that a variety of gun stocks can be created as desired. The invention also eliminates the undesirable rattling noise that modular gun stocks often have after assembly.

20 Claims, 6 Drawing Sheets

SECTION A-A

MODULAR GUN STOCKS

BACKGROUND OF THE INVENTION

A. Field of the Invention

The present invention relates to modular gun stocks and their methods of manufacture.

B. Description of the Related Art

A variety of gun stocks have been designed to suit the requirements faced by shooters in different situations, such as firing from standing, seated, or prone positions. Further, the different physical sizes of shooters has led to a variety of designs to better achieve a desired length of pull and reduce the possibility of injury due to recoil. As a result, multiple gun stocks are available in a variety of fixed sizes and shapes to customize a specific type of gun to accommodate shooters of different statures or arm lengths, or for different shooting situations.

Many gun stocks are made using injection molding manufacturing techniques. Such techniques are well known in the arts. It is also known that the existing designs for gun stocks require complicated molds for their manufacture. All of these designs appear to require that the center of the housing for a stock is created by using a large core pin, and then using a second smaller core pin to attach the housing to the stock. The side features for the stocks then are created by the mold halves, and the different parts of the stocks are assembled through a series of steps.

Ideally, a modular stock is easily removed and replaced from a gun so that a shooter can quickly and quietly move from one firing position to another. Such a modular stock would not require a separate tool to exchange one stock for another. Further, the modular stock would be held securely to the gun so that the assembly did not rattle or result in unwanted noise when a user moved. Current modular stocks often require a separate tool to attached them to a gun, and when assembled with a gun, often result in unwanted rattles or other noises that reduce the ability of a shooter to move stealthily and quietly.

SUMMARY OF THE INVENTION

The present invention provides easily replaceable lower support brackets and associated kits to create gun stocks with a variety of desirable features for different users or shooting situations. In addition, the present invention can be manufactured more easily than other existing stocks because fewer parts are needed to create the stocks of the present invention. The invention also provides improved molds for the manufacturing of the improved lower support brackets and buffer tube housings.

Another advantage of the present invention is that it provides stocks (i.e. buttstocks) that are secured to buffer tubes such that the assembly does not rattle or cause other unwanted noise when moved or shaken about. Such unwanted noises are eliminated by using a release latch, trigger mechanism, flexible tabs on the buffer tube housing, and a compression spring to hold a buffer tube firmly against a buffer tube housing into which the buffer tube has been inserted. By holding the buffer tube firmly in place, any rattling or other noise that reduce a user's ability to move stealthily or quietly are eliminated.

The invention provides lower support brackets that are attached to a buffer tube housing primarily by a modified tongue and groove configuration. While relatively secure, it is preferred that at least one fastener, preferably a screw with or without a washer, is used to secure a lower stock support to a buffer tube housing. Those of skill in the art will recognize that a variety of suitable fasteners are readily available and can be used in the invention.

Advantageously, a user can quickly and easily separate a lower support bracket from a buffer tube housing by removing any fastener(s) and simply pulling, or twisting and pulling, the lower stock support and buffer tube housing apart. The user can then attach a different lower stock support to the buffer tube housing to change the length of pull or to create a gun stock assembly suitable for a different shooting situation.

Stocks of the present invention are made using injection molding manufacturing methodology. The use of plastics and injection molding to make stocks is well-known, expensive, and requires the use of multiple complicated molds. The present invention improves upon this manufacturing process by providing improved mold designs that are less complicated, require less material, and are more easily assembled than prior designs because their use requires fewer components to assemble a gun stock.

Advantageously, the molds and manufacturing methods of the present invention separate the main housing of a gun stock (i.e. the buffer tube housing) from its lower stock support. By separating the two, the requirement for a second core pin is eliminated. Further, the elimination of the second core pin also eliminates the necessity for a hole for a latch pin that would otherwise be needed to secure the second core pin. Instead, the present invention utilizes a locking pin with a square base and a compression spring to secure the buffer tube's position in the buffer tube housing.

A particular advantage of the present invention is that it uses a locking pin with a square base rather than a round base. By doing so, each half of a manufacturing mold forms one half of a channel for a locking pin. When the molded halves are joined together, a channel for the locking pin is formed, and there is no need for a core pin. The improved mold design also eliminates any need for a cross pin.

Another advantage of the present invention is that the manufacturing molds have been designed to include multiple cavities along the exteriors of the parts without sacrificing structural integrity, and as a result a smaller amount of plastic is required to manufacture a modular gun stock of the invention as compared to conventional injection molding manufacturing techniques.

The invention also provides a set of manufacturing molds to create a variety of lower stock supports so that a user can create a variety of butts that can be useful in different shooting situations or to yield different lengths of pull. Each mold comprises a set of halves that when joined together form a piece of the invention.

A further advantage of the invention is that unwanted noise (e.g. a rattle) caused by a buffer tube moving against the buffer housing tube is eliminated. Specifically, the invention provides a means of clamping the buffer tube housing against the buffer tube after the buffer tube has been placed in a desired position by squeezing tabs on the exterior of the buffer tube housing firmly against the buffer tube. When a user desires to adjust the position of the buffer tube, the user simply applies pressure to the proximal end of a release latch to cause a trigger to rotate downward and release the pressure on the flexible tabs on the exterior of the buffer tube housing.

More specifically, the invention provides a gun stock comprising a lower support bracket and a buffer tube housing. The lower support bracket has a butt plate pad attached to a butt plate from which a first half of a modified tongue and groove joint extends forward from the center of the butt plate, and a butt support that attaches to the toe of the butt plate and the front of the first half of the modified tongue and groove joint. The buffer tube housing has a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends.

Those of skill in the art will appreciate that the modified tongue and groove joint on the buffer tube housing is split into two parts—a proximal section (i.e. near end) and a distal section (i.e. far end). It is expected that all lower support brackets of the invention can interlock or insert into the near ends of the lower support brackets. It is preferably that lower support brackets that have a longer butt support also interlock or join with the modified tongue and groove joint at the distal end of the ventral exterior of the buffer tube housing.

The lower support brackets for gun stocks of the present invention are straight butt supports, angled butt supports, or a double butt supports. Double butt supports of the present invention insert into both the near and distal ends of the second half of the modified tongue and groove joint.

A locking pin of the invention has a front side, a back side, two lateral sides, wherein each lateral side has a horizontal tab extending laterally outward, and a flattened dorsal surface from which a rounded chamber extends upward. A compression spring is housed within the locking pin and rounded chamber.

A gun stock of the present invention has a buffer tube housing with a release latch that is located on its ventral side and that includes a trigger that comprises a first tab and a second tab. Each tab extends upward from the trigger. When the release latch is not flexed, the first and second tabs of the trigger are clamped against the flexible lateral tabs of the track, which causes the flexible lateral tabs to press firmly against the buffer tube and prevent the buffer tube from impacting against the walls of the buffer tube housing to cause a rattling or other noise. When the release latch is compressed at its proximal end, the trigger and its first and second tabs rotate downward, the locking pin is flexed, and the pressure on the flexible lateral tabs of the track is released so that the buffer tube can move forward or backward within the buffer tube housing.

The invention also provides kits that comprise two or more gun stocks, wherein each gun stock includes (a) a lower support bracket having a butt plate pad, a butt plate from which a first half of a modified tongue and groove joint extends forward from the center of the butt plate, and a butt support that attaches to the toe of the butt plate and the front of the first half of the modified tongue and groove joint; and (b) a buffer tube housing having a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends.

The invention also provides methods of using these kits that comprise two or more gun stocks. Specifically, the invention provides that a user can (a) attach a first gun stock to a buffer tube, wherein the first gun stock includes a lower support bracket and a buffer tube housing, wherein the lower support bracket has a butt plate pad, a butt plate from which a first half of a modified tongue and groove joint extends forward from the center of the butt plate, and a butt support that attaches to the toe of the butt plate and the front of the first half of the modified tongue and groove joint; and the buffer tube housing has a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends; (b) remove the first gun stock from the buffer tube by sliding the first half of the modified tongue and groove joint away from the second half of the modified tongue and groove joint; and (c) replace the first gun stock with a second gun stock, wherein the second gun stock includes a lower support bracket and a buffer tube housing, wherein the lower support bracket has a butt plate pad, a butt plate from which a first half of a modified tongue and groove joint extends forward from the center of the butt plate, and a butt support that attaches to the toe of the butt plate and the front of the first half of the modified tongue and groove joint; and the buffer tube housing has a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends.

In addition, the invention provides methods of manufacturing a gun stock that comprise (a) injecting molten material into a first mold for a butt plate pad; (b) injecting molten material into a second mold for a butt plate, wherein the butt plate has a first half of a modified tongue and groove joint extending forward from the center of the butt plate, and a butt support extending from the toe of the butt plate to the front of the first half of the modified tongue and groove joint; (c) attaching the butt plate pad to the butt plate to form a lower support bracket; (d) injecting molten material into a third mold for a buffer tube housing, wherein the buffer tube housing has a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends; (e) injecting molten material into a fourth mold for a release latch, wherein the release latch includes a trigger that comprises a first tab and a second tab, and each tab extends upward from the trigger; (f) injecting molten material into a fifth mold for a locking pin, wherein the locking pin has a front side, a back side, two lateral sides, wherein each lateral side has a tab that extending laterally outward, and a flattened dorsal surface from which a rounded chamber extends upward; (g) inserting a compression spring into the locking pin such that the compression spring can extend into the rounded chamber; (h) sliding the compression spring and locking pin combination onto the release latch such that the locking pin is situated between the first and second tabs of the release latch and the rounded chamber extends upward; (i) attaching the combined compression spring, locking pin, and release latch to the bottom of the buffer tube housing such that the rounded chamber of the locking pin extends through the ventral hole of the track, first and second tabs of the trigger are pressed against the exterior of the track, and when the proximal end of the release latch is compressed the first and second tabs of the trigger rotate downward and the compression spring is flexed; and (j) inserting the first half of the modified tongue and groove joint into the second half of the modified tongue and groove joint.

Methods of manufacture further include attaching the butt plate pad to the butt plate with at least one fastener and attaching the lower support bracket to the buffer tube housing with at least one fastener.

The invention also provides a set of five manufacturing molds. A first mold is for a butt plate pad. A second mold is for a butt plate, wherein the butt plate has a first half of a modified tongue and groove joint extending forward from the center of the butt plate, and a butt support extending from the toe of the butt plate to the front of the first half of the modified tongue and groove joint. A third mold is for a buffer tube housing, wherein the buffer tube housing has a comb that has a rounded crown and is open at its distal and proximal ends, a rectangular track extending the length of the buffer tube, wherein the track is open on its dorsal side and at its distal and proximal ends, has a flexible tab on each side near its center, and includes a hole on its bottom side that is in the same vertical plane as the flexible tabs, a release latch, a compression spring, a locking pin, and a second half of the modified tongue and groove joint on the ventral exterior of the buffer tube housing at its near and distal ends. A fourth mold is for a release latch, wherein the release latch includes a trigger that comprises a first tab and a second tab, and each tab extends upward from the trigger. And, a fifth mold is for a locking pin, wherein the locking pin has a front side, a back side, two lateral sides, wherein each lateral side has a tab that extending laterally outward, and a flattened dorsal surface from which a rounded chamber extends upward.

Herein, the top end of a butt plate is understood to be the "heel" of the butt plate, and the bottom end of a butt plate is understood to be the "toe" of the butt plate.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description. Further, while specific advantages of the invention are detailed herein, various embodiments may include some, none, or all of these enumerated advantages.

BRIEF DESCRIPTION OF THE DRAWINGS

The following drawings form part of the present specification and are included to further demonstrate certain aspects of the present invention. The invention may be better understood by reference to one or more of these drawings in combination with the detailed description presented herein. Unless specifically noted, articles depicted in the drawings are not necessarily drawn to scale.

DETAILED DESCRIPTION

The invention provides replaceable lower support brackets that allow users to create a variety of gun stocks that a suitable for different shooting situations, e.g. sitting, standing, or prone positions. In addition, the lengths of pull for the gun stocks of the invention can be easily adjusted to accommodate different users or situations.

Figure 1:
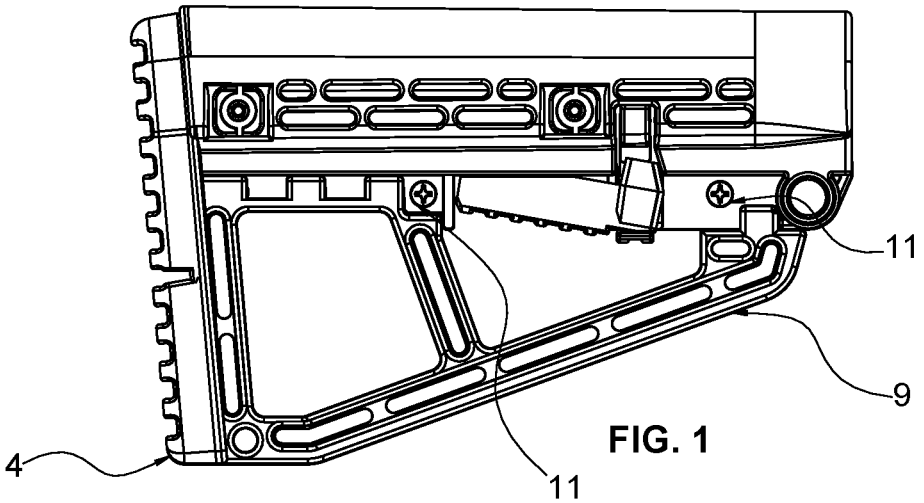
FIG. 1 is a side view of one embodiment of a modular gun stock having a straight butt with a central brace.
Figure 2:
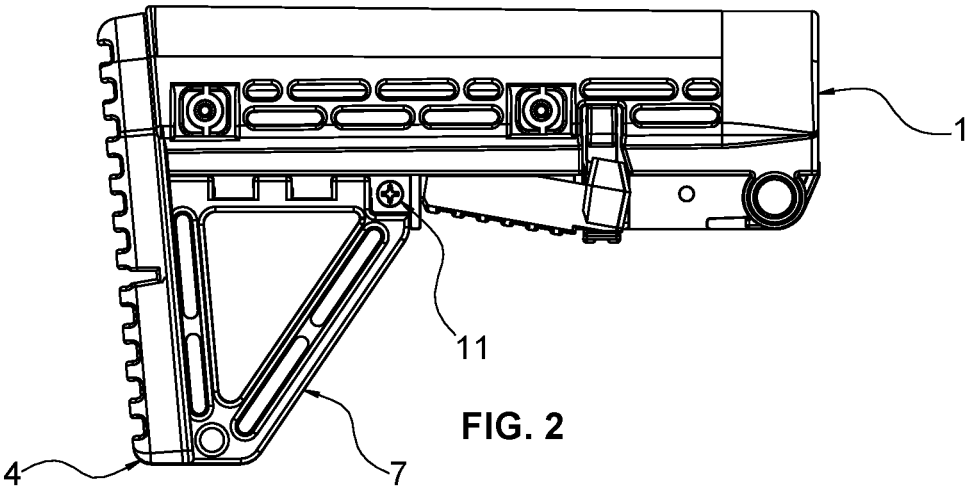
FIG. 2 is a side view of another embodiment of a short modular gun stock with a straight butt.
Figure 3:
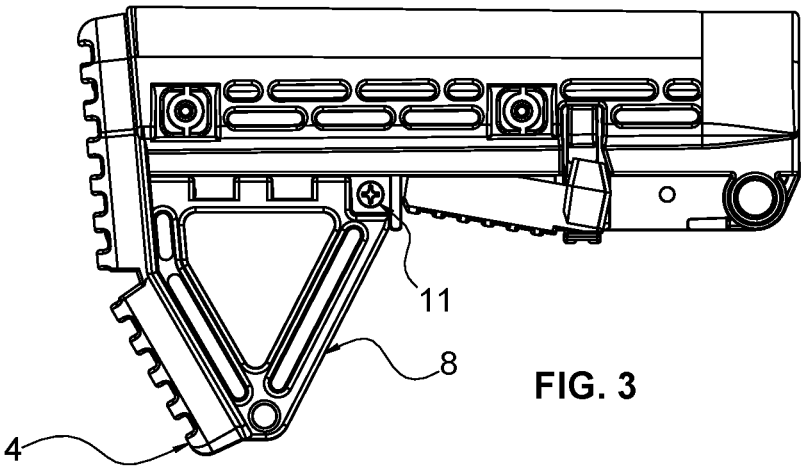
FIG. 3 is a side view of another embodiment of a short modular gun stock having an angled butt.

Three different gun stocks of the invention that have different lower support brackets 4 (or butts) attached to a buffer tube housing 1 are illustrated in FIGS. 1-3. Those of skill in the art will appreciate that other variations of the illustrated lower support brackets may be used with the invention as long as the variations include the necessary elements to function in the invention.

Specifically, a gun stock with a double butt support 9 is shown in FIG. 1. FIG. 2 illustrates a gun stock with straight butt support 7. And, in FIG. 3 a gun stock with an angled butt support 8 is shown. As can be seen by comparing FIGS. 2 and 3 to FIG. 1, a longer lower support bracket can include an additional brace or cross member to provide better stabilize it against the buffer tube housing. Longer lower support brackets are also stabilized by attaching them to both the proximal and distal ends of a buffer tube housing 1 as shown in FIG. 1. The attachment of butt supports to buffer tube housings can be better understood by referring to FIGS. 4-9.

Figure 4:
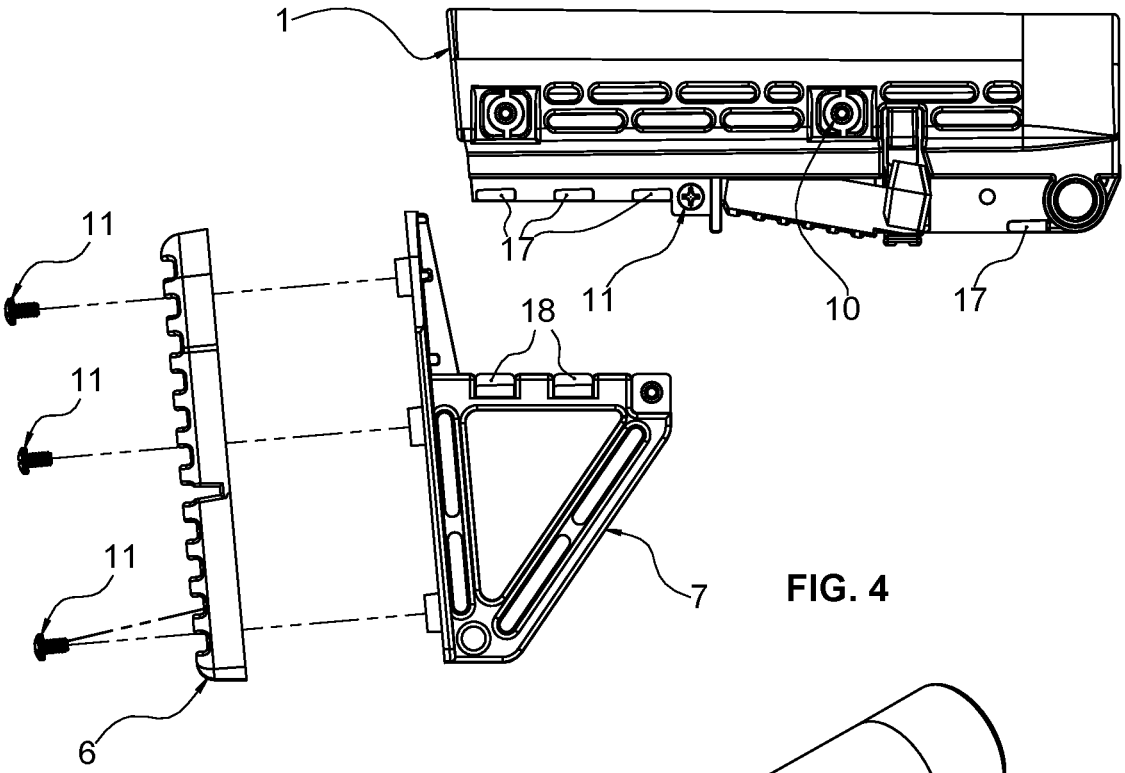
FIG. 4 is a side view of the embodiment of FIG. 2 with the butt separated from the buffer tube housing and the butt disassembled.
Figure 5:
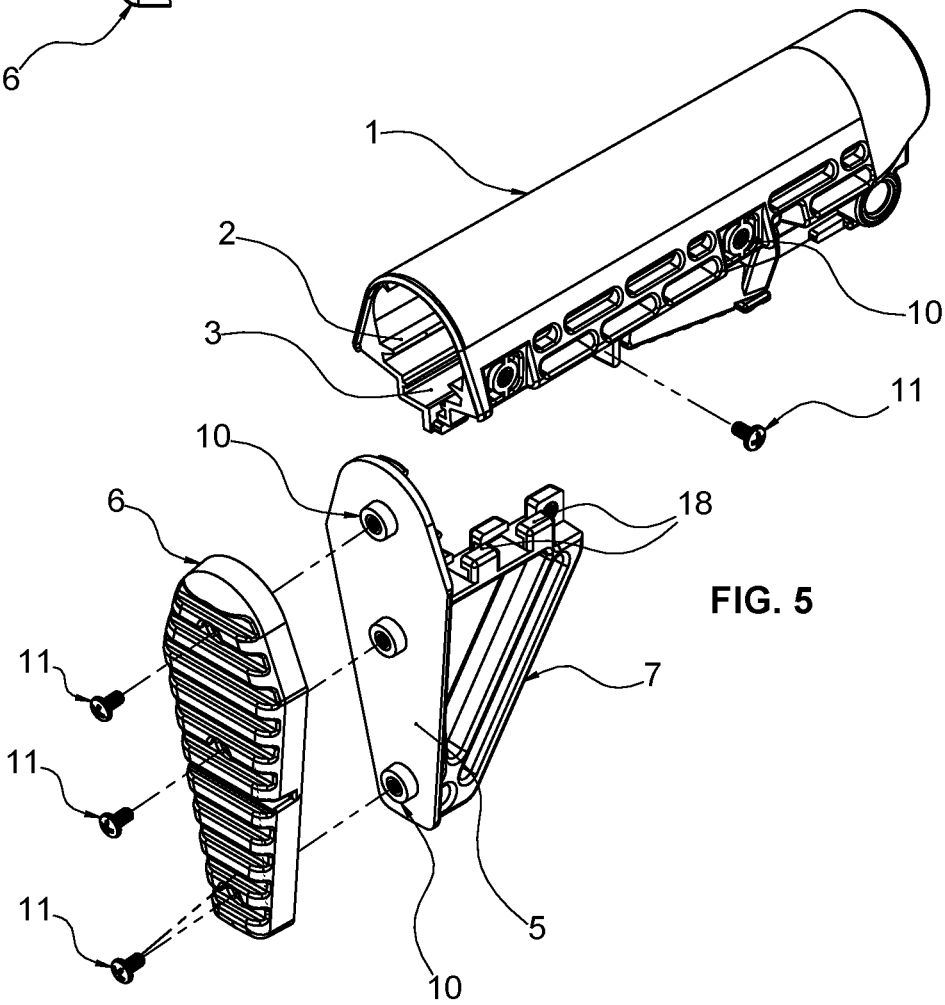
FIG. 5 is a perspective view of the embodiment of FIG. 2 with the butt separated from the buffer tube housing and the butt disassembled.
Figure 6:
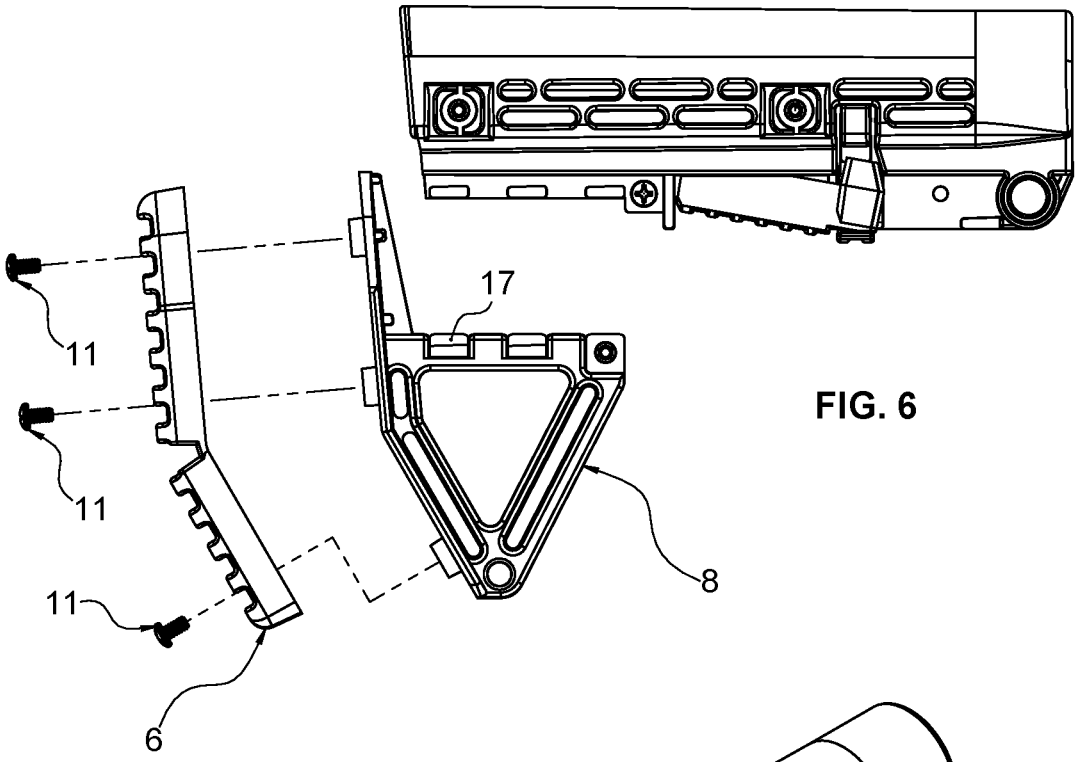
FIG. 6 is a side view of the embodiment of FIG. 3 with the butt separated from the buffer tube housing and the butt disassembled.
Figure 7:
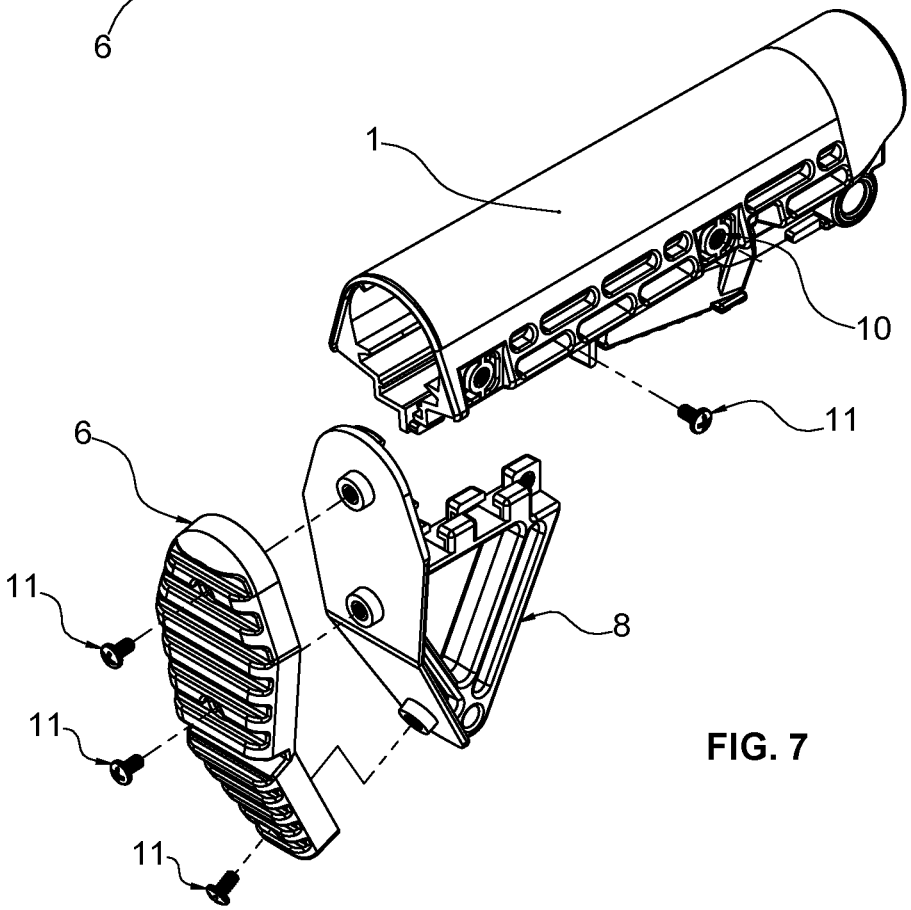
FIG. 7 is a perspective view of the embodiment of FIG. 3 with the butt separated from the buffer tube housing and the butt disassembled.
Figure 8:
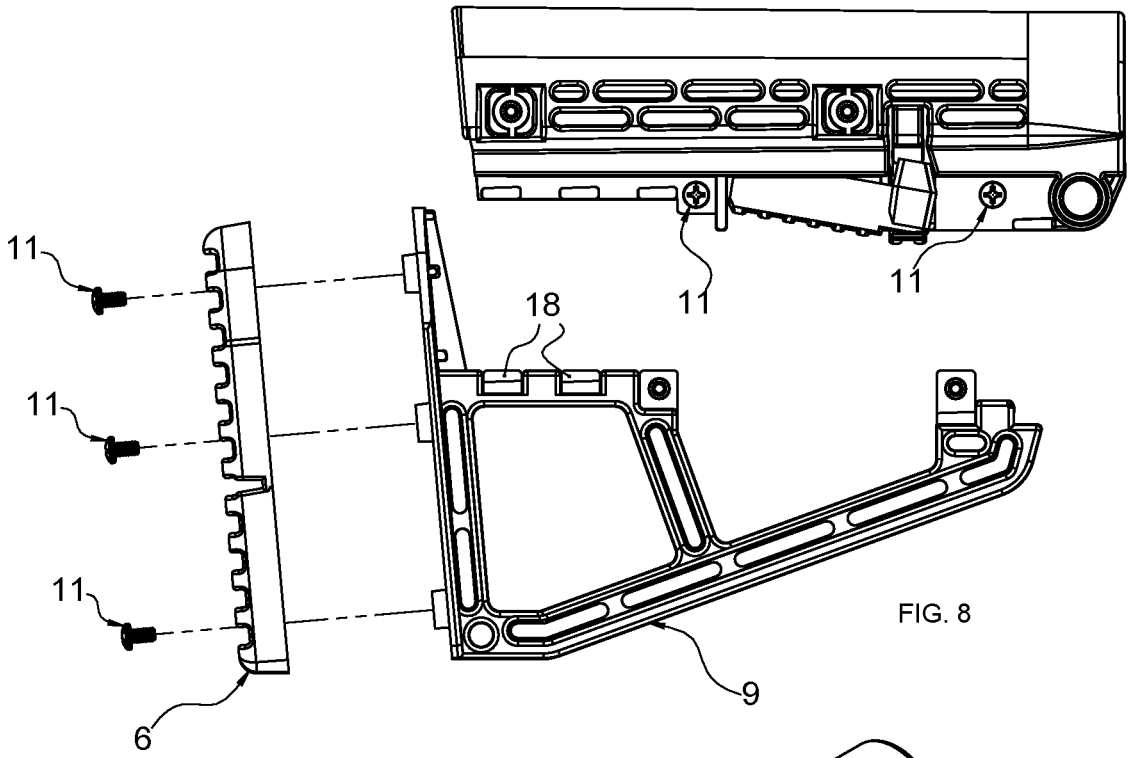
FIG. 8 is a side view of the embodiment of FIG. 1 with the butt separated from the buffer tube housing and the butt disassembled.
Figure 9:
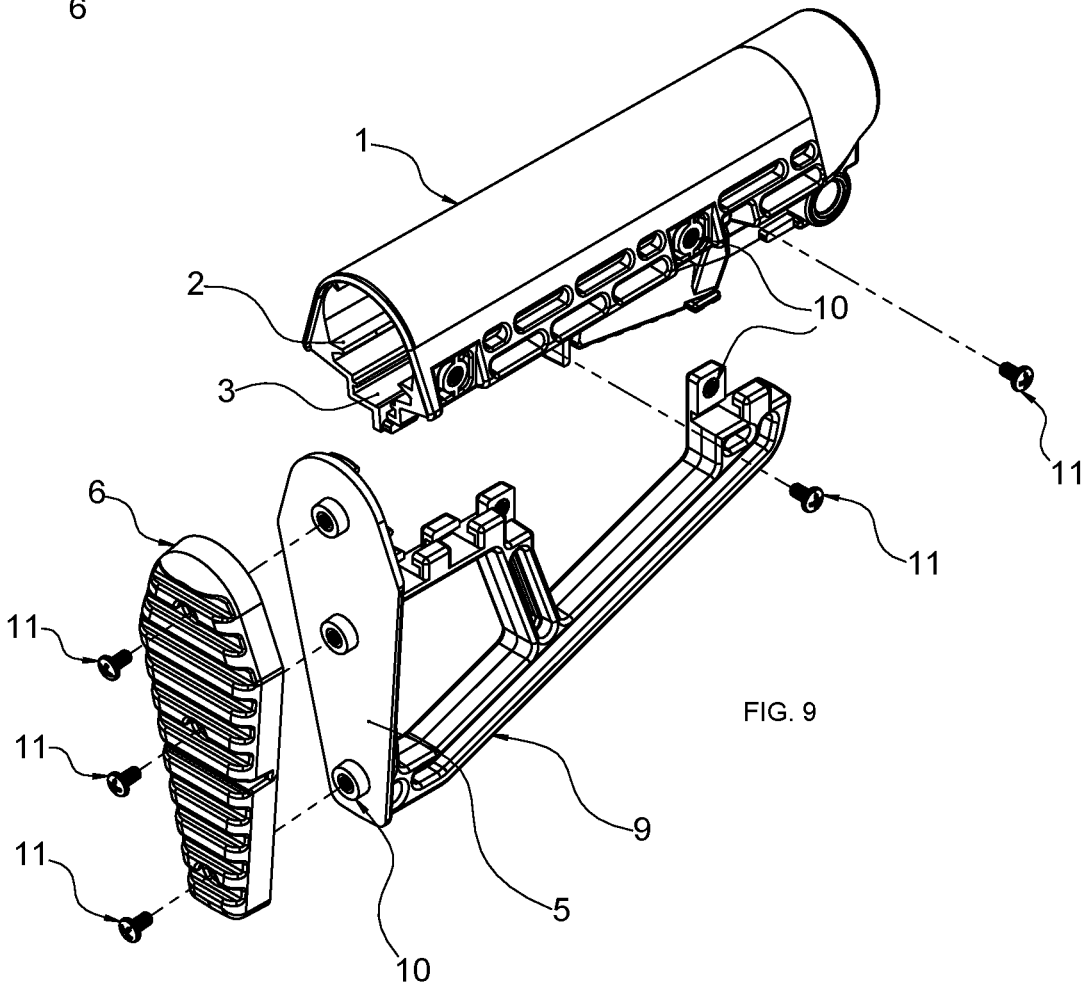
FIG. 9 is a perspective view of the embodiment of FIG. 1 with the butt separated from the buffer tube housing and the butt disassembled.
Figure 10:
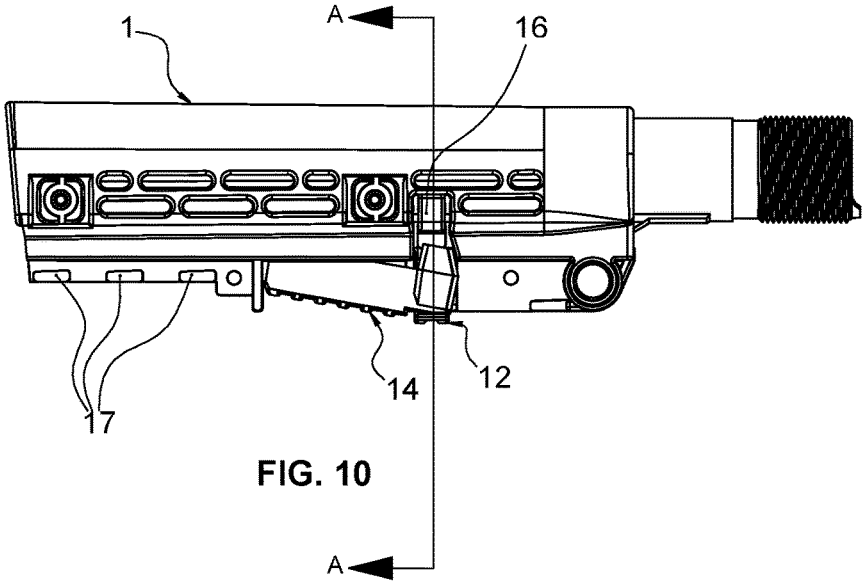
FIG. 10 is a side view of a buffer tube housing that indicates the location of the cross-section shown in FIG. 11.
Figure 11:
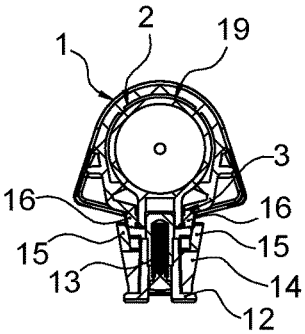
FIG. 11 is a cross-sectional view of a buffer tube housing.
Figure 12:
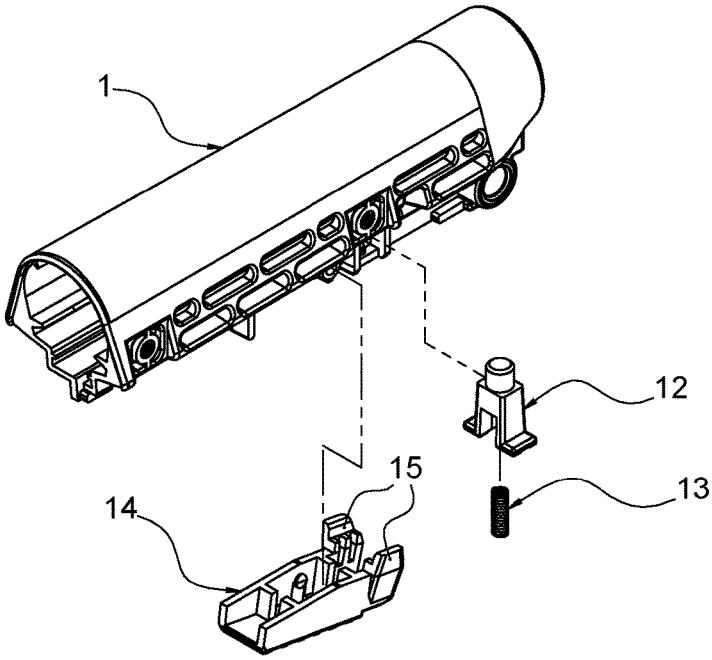
FIG. 12 is an exploded view of a buffer tube housing.
Figure 13:
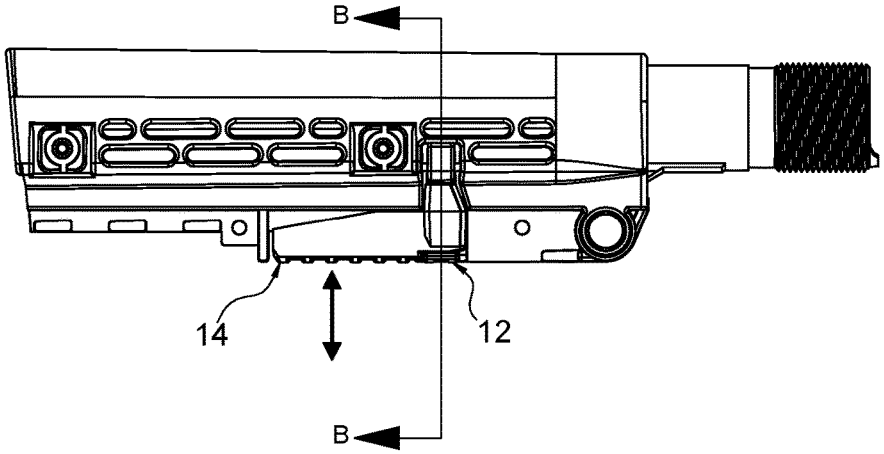
FIG. 13 is a side view of a buffer tube housing with the release latch in the decompressed position.
Figure 14:
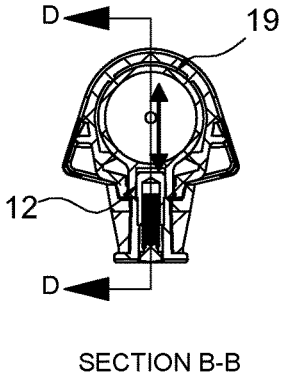
FIG. 14 is cross-sectional view of a buffer tube housing with the release latch in the decompressed position.
Figure 15:
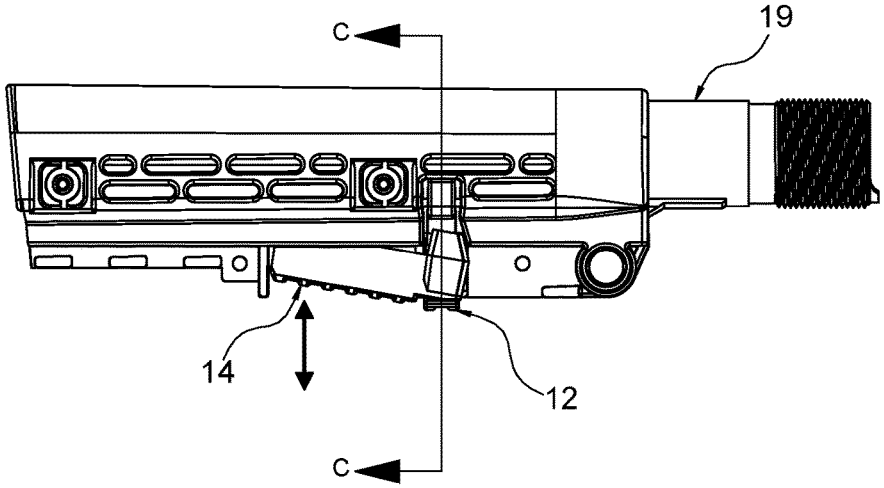
FIG. 15 is a side view of a buffer tube housing with the release latch in the compressed position.
Figure 16:
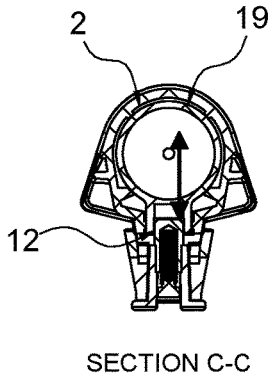
FIG. 16 is cross-sectional view of a buffer tube housing with the release latch in the compressed position.

FIGS. 4 and 5 provide an exploded view of the different parts of a straight butt support and their relationship to a buffer tube housing 1; FIGS. 6 and 7 provide an exploded view of the different parts of an angled butt support and their relationship to a buffer tube housing 1; and FIGS. 8 and 9 provide an exploded view of the different parts of a double butt support and their relationship to a buffer tube housing 1.

For all lower support brackets 4, a butt plate pad 6 is attached to a butt plate 5. Preferably, fasteners 11 attach a butt plate pad 6 to a butt plate 5. Preferred fasteners are screws that extend through the butt plate pad 6 into threaded holes 10 that are in the vertical face of butt plate 5. Those of skill in the art will appreciate that butt supports can be attached to butt plates by other means such as adhesives, clips, or other known means and achieve a similar result.

Butt plates of the invention are single pieces that function as if they had multiple parts. For ease of discussion herein, butt plates of the invention are described as if they consisted of multiple parts. Specifically, butt plates of the invention have a first half of a modified tongue and groove joint 18 that extends forward and horizontally from about the center of the butt plate 5. The distal end of the first half of a modified tongue and groove joint 18 attaches to the distal end of butt support (either part 7, 8, or 9) and the toe of the butt plate 5 attaches to the proximal end of the same support.

Lower support brackets 4 are attached to buffer tube housings 1 by sliding (or sliding and twisting) the first half of a modified tongue and groove joint 18 to the second half of a modified tongue and groove joint 17 that extends from the ventral surface of the buffer tube housing 1. A lower support bracket 4 is secured in place with at least one fastener 11. Preferably, the fastener is a screw that threaded through an opening 10 in the lower support bracket 4 and into another opening 10, preferably a threaded screw hole, in the buffer tube housing 1.

Buffer tube housings of the invention are single pieces that functionally act as if they consisted of multiple parts. For ease of discussion herein, buffer tube housings of the invention are described as if they consisted of multiple parts.

Figure 17:
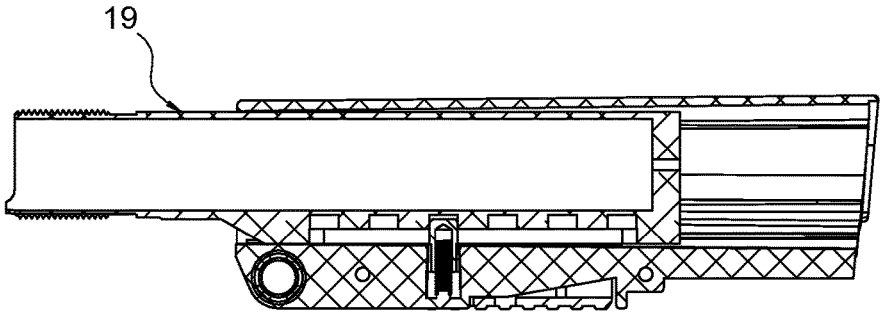
FIG. 17 is a cross-sectional view that illustrates a pin locking into the buffer tube.

A buffer tube housing 1 has a comb 2 that forms the hollow upper part of the housing. A buffer tube 19 is inserted into the comb 2. See FIG. 17. Skilled artisans will be familiar with buffer tubes and other parts that are commonly used in modular guns. The lower portion of a buffer tube housing 1 is a track 3. A track 3 is roughly rectangular in shape and extends the length of the buffer tube housing 1. A track includes a hole in the central area of its ventral surface. The function and position of the hole in the track can be better understood by referring to FIGS. 10-17 and the following discussion.

The buffer tube housing 1 further includes a locking pin 12 that has a lower portion that is roughly cuboid in shape and has a front side, back side, and two lateral sides and an upper portion that is a rounded chamber that extends upward from the flattened surface of the dorsal surface of its lower portion. At the bottom of each of the two lateral sides of the locking pin 12 is a horizontal tab that extends outward from the locking pin. The rounded chamber of the locking pin 12 extends through the hole in the central area of the track 3. Within locking pin 12 is a compression spring 13. When at rest, the compression spring 13 is compressed within the locking pin.

Seated on the horizontal tabs of the locking pin 12 is the front or distal portion of a release latch 14. The release latch 14 includes a trigger 15 that comprises a first tab and a second tab. Each tab extends upward from the trigger 15. When at rest, the first and second tabs of the trigger 15 compress the lateral tabs 16 on the track 3 (i.e. the track tabs) to hold a buffer tube 19 firmly in place. By holding the buffer tube 19 firmly in place, the buffer tube and buffer tube housing cannot be moved against each other to result in unwanted noise (e.g. a rattle).

When the proximal end of release latch 14 is compressed, the tabs on the trigger 15 rotate downward and release the tension on the compression spring 13 within the locking pin 12 so that the locking pin 12 is flexed, the pressure on the track tabs 16 is released, and the buffer tube 19 can be moved within the comb 2 of the buffer tube housing 1.

Unless defined otherwise, all technical and scientific terms used herein have the same meaning as is commonly understood by one of skill in the art to which this invention belongs at the time of filing. Terminology used herein is for the purpose of describing exemplary embodiments of the invention and is not intended to be limiting. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular unless the content clearly dictates otherwise. Herein, the use of "or" means "and/or" unless stated otherwise. Furthermore, the use of the terms "including", "comprising", as well as other forms such as "includes", "included", "comprises", "comprised", or similar terminology is not limiting. As used herein, "each" refers to each member of a set or each member of a subset of a set. All patents and publications referred to herein are incorporated by reference to the extent that they provide exemplary procedural or other details supplementary to those set forth herein.

It should be appreciated by those of skill in the art that the techniques disclosed herein represent techniques discovered by the inventors to function well in the practice of the invention, and thus can be considered to constitute preferred modes of practice. However, those of skill in the art should appreciate that many changes can be made to the specific embodiments which are disclosed and still obtain a like or similar result without departing from the spirit or scope of the invention. Thus, the present invention should not be limited to the exemplary embodiments and techniques illustrated herein.

What is claimed is:

1. A gun stock comprising:

a) a lower support bracket having a butt plate pad, a butt plate from which a first half of a modified tongue and groove joint extends forward from a center of the butt plate, and a butt support that attaches to a toe of the butt plate and a front of the first half of the modified tongue and groove joint; and b) a buffer tube housing having a comb that has a rounded crown and is open at a distal and proximal end, a rectangular track extending a length of the buffer tube, wherein the track is open on a dorsal side and at a distal and proximal ends, a flexible tab on each side of said buffer tube housing near a center, and includes a hole on a bottom side that is in a same vertical plane as the flexible tabs, a release latch, a compression spring, a locking pin, and a second half of the modified tongue and groove joint on a ventral exterior of the buffer tube housing at a near and distal ends.

2. The gun stock of claim 1, wherein the first half of the modified tongue and groove joint inserts into the near end of the second half of the modified tongue and groove joint.

3. The gun stock of claim 1, wherein the lower support bracket is a straight butt support, an angled butt support, or a double butt support.

4. The gun stock of claim 3, wherein the lower support bracket is a double butt support and inserts into both the near and distal ends of the second half of the modified tongue and groove joint.

5. The gun stock of claim 1, wherein the locking pin has a front side, a back side, two lateral sides, wherein each lateral side has a tab that extending laterally outward, and a flattened dorsal surface from which a rounded chamber extends upward, and the compression spring is housed within the locking pin and rounded chamber.

6. The gun stock of claim 1, wherein at a distal end the release latch includes a trigger that comprises a first tab and a second tab, and each tab extends upward from the trigger.

7. The gun stock of claim 6, wherein when the release latch is not flexed the first and second tabs of the trigger are clamped against the flexible tabs of the track.

8. The gun stock of claim 6, wherein when the release latch is compressed at a proximal end, the trigger and first and second tabs of said trigger rotate downward, the locking pin is flexed, and the pressure on the flexible tabs of the track is released.

9. A kit comprising two or more gun stocks, wherein each gun stock includes:

a) a lower support bracket having a butt plate pad, a butt plate from which a first half of a modified tongue and groove joint extends forward from a center of the butt plate, and a butt support that attaches to a toe of the butt plate and a front of the first half of the modified tongue and groove joint; and b) a buffer tube housing having a comb that has a rounded crown and is open at a distal and proximal end, a rectangular track extending a length of the buffer tube, wherein the track is open on a dorsal side and at a distal and proximal ends, a flexible tab on each side of said buffer tube housing near its center, and includes a hole on a bottom side that is in a same vertical plane as the flexible tabs, a release latch, a compression spring, a locking pin, and a second half of the modified tongue and groove joint on a ventral exterior of the buffer tube housing at a near and distal ends.

10. The kit of claim 9, wherein the first half of the modified tongue and groove joint inserts into the near end of the second half of the modified tongue and groove joint.

11. The kit of claim 9, wherein the lower support bracket is a straight butt support, an angled butt support, or a double butt support.

12. The kit of claim 11, wherein the lower support bracket is a double butt support and inserts into both the near and distal ends of the second half of the modified tongue and groove joint.

13. The kit of claim 9, wherein the locking pin has a front side, a back side, two lateral sides, wherein each lateral side has a tab that extending laterally outward, and a flattened dorsal surface from which a rounded chamber extends upward, and the compression spring is housed within the locking pin and rounded chamber.

14. The kit of claim 9, wherein at its distal end the release latch includes a trigger that comprises a first tab and a second tab, and each tab extends upward from the trigger.

15. The kit of claim 14, wherein when the release latch is not flexed the first and second tabs of the trigger are clamped against the flexible tabs of the track.

16. The kit of claim 14, wherein when the release latch is compressed at a proximal end, the trigger and first and second tabs of said trigger rotate downward, the locking pin is flexed, and the pressure on the flexible tabs of the track is released.

17. A method of using a kit of two or more gun stocks comprising:

a) attaching a first gun stock to a buffer tube, wherein the first gun stock includes a lower support bracket and a buffer tube housing, wherein the lower support bracket has a butt plate pad, a butt plate from which a first half of a modified tongue and groove joint extends forward from a center of the butt plate, and a butt support that attaches to a toe of the butt plate and a front of the first half of the modified tongue and groove joint; and the buffer tube housing has a comb that has a rounded crown and is open at a distal and proximal end, a rectangular track extending a length of the buffer tube, wherein the track is open on a dorsal side and at a distal and proximal end and includes a hole near a center on a bottom side, a release latch, a compression spring, a locking pin, and a second half of the modified tongue and groove joint on a ventral exterior of the buffer tube housing at a near and distal end;

b) removing the first gun stock from the buffer tube; and c) replacing the first gun stock with a second gun stock, wherein the second gun stock includes a lower support bracket and a buffer tube housing, wherein the lower support bracket has a butt plate pad, a butt plate from which a first half of a modified tongue and groove joint extends forward from the center of the butt plate, and a butt support that attaches to a toe of the butt plate and a front of the first half of the modified tongue and groove joint; and the buffer tube housing has a comb that has a rounded crown and is open at a distal and proximal end, a rectangular track extending the length of the buffer tube, wherein the track is open on a dorsal side and at a distal and proximal end and includes a hole near a center on a bottom side, a release latch, a compression spring, a locking pin, and a second half of the modified tongue and groove joint on a ventral exterior of the buffer tube housing at a near and distal end.

18. A method of manufacturing a gun stock comprising:

a) injecting molten material into a first mold for a butt plate pad;

b) injecting molten material into a second mold for a butt plate, wherein the butt plate has a first half of a modified tongue and groove joint extending forward from a center of the butt plate, and a butt support extending from a toe of the butt plate to a front of the first half of the modified tongue and groove joint;

c) attaching the butt plate pad to the butt plate to form a lower support bracket;

d) injecting molten material into a third mold for a buffer tube housing, wherein the buffer tube housing has a comb that has a rounded crown and is open at a distal and proximal end, a rectangular track extending a length of the buffer tube, wherein the track is open on a dorsal side and at a distal and proximal end, a flexible tab on each side of said buffer tube housing near a center, and includes a hole on a bottom side that is in a same vertical plane as the flexible tabs, a release latch, a compression spring, a locking pin, and a second half of the modified tongue and groove joint on a ventral exterior of the buffer tube housing at a near and distal end;

e) injecting molten material into a fourth mold for a release latch, wherein the release latch includes a trigger that comprises a first tab and a second tab, and each tab extends upward from the trigger;

f) injecting molten material into a fifth mold for a locking pin, wherein the locking pin has a front side, a back side, two lateral sides, wherein each lateral side has a tab that extending laterally outward, and a flattened dorsal surface from which a rounded chamber extends upward;

g) inserting a compression spring into the locking pin such that the compression spring can extend into the rounded chamber;

h) sliding the compression spring and locking pin combination onto the release latch such that the locking pin is situated between the first and second tabs of the release latch and the rounded chamber extends upward;

i) attaching a combined compression spring, locking pin, and release latch to the bottom of the buffer tube housing such that the rounded chamber of the locking pin extends through the ventral hole of the track, first and second tabs of the trigger are pressed against the exterior of the track, and when the proximal end of the release latch is compressed the first and second tabs of the trigger rotate downward and the compression spring is flexed; and j) inserting the first half of the modified tongue and groove joint into the second half of the modified tongue and groove joint.

19. The method of manufacturing a gun stock of claim 18 further comprises attaching the butt plate pad to the butt plate with at least one fastener and attaching the lower support bracket to the buffer tube housing with at least one fastener.

20. A set of manufacturing molds for a gun stock comprising:

a) a first mold for a butt plate pad;

b) a second mold for a butt plate, wherein the butt plate has a first half of a modified tongue and groove joint extending forward from a center of the butt plate, and a butt support extending from a toe of the butt plate to a front of the first half of the modified tongue and groove joint;

c) a third mold for a buffer tube housing, wherein the buffer tube housing has a comb that has a rounded crown and is open at a distal and proximal end, a rectangular track extending a length of the buffer tube, wherein the track is open on a dorsal side and at a distal and proximal end, the buffer tube housing has a flexible tab on each side near a center, and includes a hole on a bottom side that is in a same vertical plane as the flexible tabs, a release latch, a compression spring, a locking pin, and a second half of the modified tongue and groove joint on a ventral exterior of the buffer tube housing at a near and distal;

d) a fourth mold for a release latch, wherein the release latch includes a trigger that comprises a first tab and a second tab, and each tab extends upward from the trigger; and e) fifth mold for a locking pin, wherein the locking pin has a front side, a back side, two lateral sides, wherein each lateral side has a tab that extending laterally outward, and a flattened dorsal surface from which a rounded chamber extends upward.

* * * * *